US005125356A

United States Patent [19]

Galante

[11] Patent Number: 5,125,356

[45] Date of Patent: Jun. 30, 1992

[54] MISSING CARD WARNING DEVICE

[76] Inventor: Vincent F. Galante, 2003 Oak Bluff Dr., Arlington, Tex. 76006

[21] Appl. No.: 675,738

[22] Filed: Mar. 27, 1991

[51] Int. Cl.[5] ..... G08B 5/02; G01D 13/00

[52] U.S. Cl. ..... 116/200; 116/1

[58] Field of Search ..... 116/1, 200; 150/133, 150/134, 145, 147, 148, 149, 150; 206/39

[56] References Cited

U.S. PATENT DOCUMENTS

| | | | |
|---|---|---|---|
| 2,707,930 | 5/1955 | Miles | 116/200 |
| 2,767,756 | 10/1956 | Niles | 150/39 |
| 3,369,585 | 2/1968 | Martinsen | 206/37 |
| 3,648,832 | 3/1972 | Kirshenbaum et al. | 206/37 |
| 4,697,698 | 10/1987 | Holdener | 206/39.4 |
| 4,717,908 | 1/1988 | Phillips et al. | 340/568 |
| 4,719,453 | 1/1988 | Beck et al. | 340/568 |
| 4,852,727 | 8/1989 | Oberle | 206/39.4 |
| 5,052,328 | 10/1991 | Eppenbach | 116/200 |

*Primary Examiner*—William A. Cuchlinski, Jr.
*Assistant Examiner*—W. Morris Worth
*Attorney, Agent, or Firm*—Kenneth C. Hill; Duke W. Yee

[57] ABSTRACT

A device is disclosed for alerting an owner of a credit card, debit card, or the like of a situation in which a card is missing from a card holder device. The device comprises a substantially planar sheet having an surface, a lower surface, an aligning edge, and at least two vacant edges and being configured for placement behind a card in a card holder device; and a substantially planar member positioned longitudinally along the aligning edge, the substantially planar member having a fixed edge affixed to the planar sheet and a free edge normally being biased in a direction away from the surface, the free edge being forced in a direction against the surface when pressure is applied toward the substantially planar member. The fixed edge may be affixed proximate the aligning edge or a vacant edge.

18 Claims, 3 Drawing Sheets

MISSING CARD WARNING DEVICE

BACKGROUND OF THE INVENTION

1. Field of the Invention:

The present invention relates in general to a device for use in a pocketbook or card holder and in particular to a device for altering a card owner of a situation in which a card is missing from the pocketbook or card holder.

2. Description of the Prior Art:

In recent years, the use of credit cards, identification cards, and other cards has increased dramatically in the United States and around the world. It is not uncommon for an individual to carry at least five cards during daily activities. The term "card" used to refer to card such as, but not limited to, debit cards, bank credit cards, gasoline credit cards, merchant credit cards, identification cards, and the like. In carrying these cards, over the years, a number of different card case structures have been adapted to store a plurality of cards.

The use of cards has brought on a problem that periodically occurs to some card owners. Specifically, the problem is losing or inadvertently forgetting a card used in a transaction during daily activities. For example, when purchasing goods, a card owner may use a credit card or a debit card to transfer funds for payment. If the card owner forgets to retrieve his/her card and return it to the card holder after making a purchase transaction, the card is out of the owner's control. This occurrence may cause the card owner an inconvenience until the card is retrieved or returned. Even worse, the card may never return to the owner's possession and becomes lost or stolen. In addition, the card issuer must bear the immediate administrative cost of documenting the lost and stolen card. Eventually, this cost is past on to the card owner.

It is known in the prior art to provide a card case with an alarm system so that the card case's owner is notified or signalled when an attempt is made to return the card case to its storage position within the owner's pocket or purse without all the cards being present. One system is a mechanical interference system as shown in U.S. Pat. Nos. 3,369,585 and 3,648,832. U.S. Pat. No. 3,369,585 is a mechanical interference system involving a card carrying pocketbook containing a resiliently biased clip adapted to accept and forcibly, though removably, retain a single credit card therebetween. The intentional or inadvertent removal of a card from between the clip forces the folder into an open position to alert and continuously remind the owner that the card is absent from the pocketbook.

U.S. Pat. No. 3,648,832 is also a mechanical interference system involving a carrying case with a plurality of card holders pivotally mounted within the carrying case. Each card holder assumes one configuration when a card is not positioned therein and is deformed to a second configuration when a card is inserted in the card holder. An abutment means is provided in the case that obstructs any frame that does not have a card contained in the card holder, whereupon the card holder cannot be pivotally moved into the base or cover section of the case. As a result, the case cannot be closed. If all the card holders contain cards, the card holders assume a configuration allowing the case to be closed.

U.S. Pat. No. 4,717,908 involves a credit card case adapted to store a stack of credit cards cooperating with an alarm system that incorporates a single credit card sensor for sensing the presence of all the cards in the card stack.

The prior art involves card holders with relatively complex alarm systems that are expensive to manufacture. Furthermore, they require the purchase of a new card holder rendering already purchased card holders useless. The prior art does not disclose a simple warning device for use in already existing credit card holders.

Therefore, it should be apparent that a device for alerting a card owner of a situation in which a card is missing from a card holder device and is relatively inexpensive to manufacture and/or may be easily incorporated into existing card holder devices is desirable.

SUMMARY OF THE INVENTION

It is therefore one object of the present invention to provide a device for alerting a card owner of a situation in which a card is missing from a card holder device.

It is another object of the present invention to provide a device for alerting a card owner of a situation in which a card is missing from a card holder that is relatively inexpensive to manufacture.

It is yet another object of the present invention to provide a device for alerting a card owner of a situation in which a card is missing from a card holder device that may be incorporated into existing card holder devices.

The foregoing objects are achieved as is now described. A device is disclosed for alerting a card owner of a situation in which a card is missing from a card holder device. The device comprises a substantially planar sheet having a surface, an aligning edge, and at least two vacant edges and being configured for placement behind a card in a card holder device; and a substantially planar member positioned longitudinally along the aligning edge, the substantially planar member having a fixed edge affixed to the planar sheet and a free edge normally being biased in a direction away from the surface, the free edge being forced towards the surface when pressure is applied against the substantially planar member in a direction towards the surface. The fixed edge may be affixed proximate the aligning edge or a vacant edge.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DESCRIPTION OF THE PREFERRED EMBODIMENT

Figure 1:
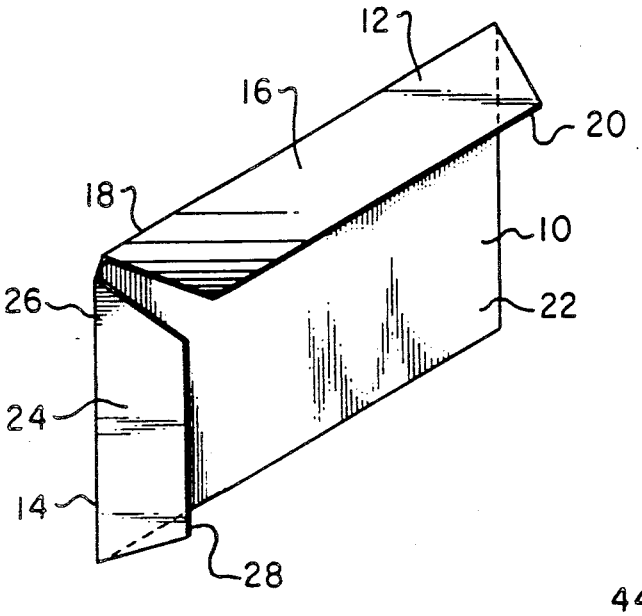
FIG. 1 is a perspective view of one embodiment of the present invention.

With reference now to the figures and in particular with reference to FIG. 1, a missing card warning device comprising a substantially planar sheet 10 with two aligning edges, a longitudinal aligning edge 12 and a transverse aligning edge 14. A longitudinal flap 16 aligned longitudinally along the longitudinal aligning edge 12 has a fixed longitudinal edge 18 that is attached to the longitudinal aligning edge 12. The longitudinal free edge 20 of the longitudinal flap 16 is normally biased in a direction away from the surface 22. When pressure is applied against the longitudinal flap 16, the longitudinal free edge 20 is forced in a direction towards the surface 22. In addition, the missing card warning device has a transverse flap 24 with a transverse fixed edge 26 attached to the transverse aligning edge 14 of the planar sheet 10. Similarly the transverse free edge 28 of the transverse flap 24 is normally biased away from the surface 22. Like the longitudinal free edge 20, the transverse free edge 28 is forced towards the surface 22 of the planar sheet 10 when pressure is applied against the transverse flap 24 in a direction towards the surface.

Figure 2:
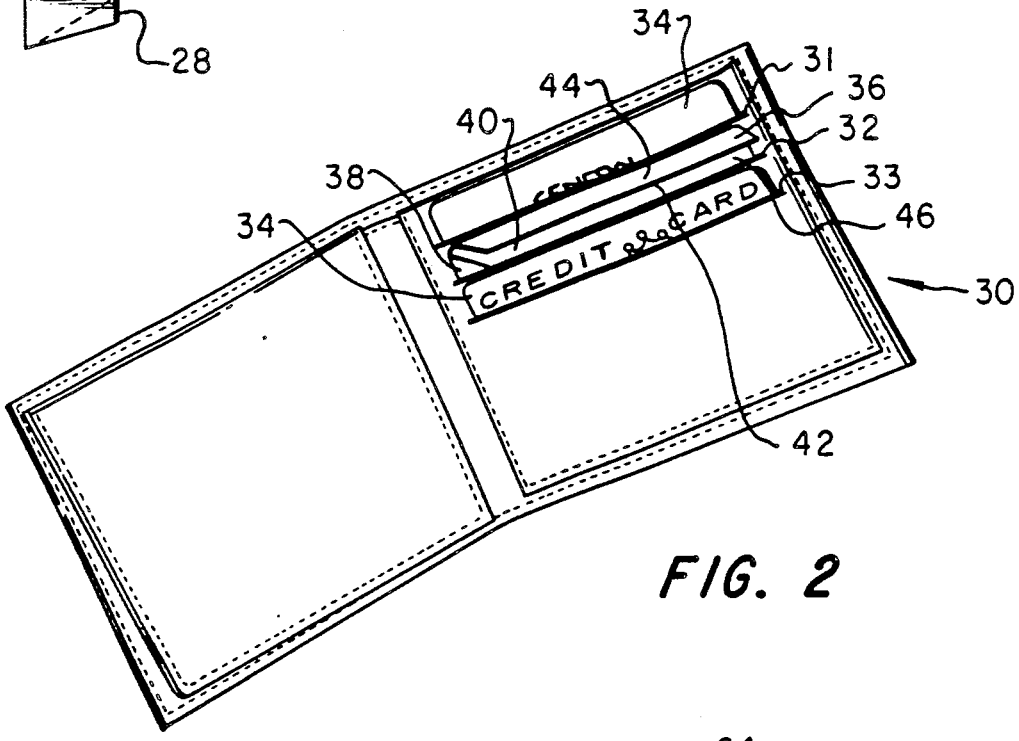
FIG. 2 is a perspective view of a wallet with one embodiment of the device placed within a card slot.

FIG. 2 depicts a wallet 30 containing slots 31, 32, and 33 for cards 34. The missing card warning device 36 is shown placed into a slot 32. The transverse flap 38 is shown in a position forced in a direction towards the surface 40. When a card is not placed in the slot 32 with the missing card warning device 36, the longitudinal free edge 42 of the longitudinal flap 44 is biased in a direction away from the surface 40 of the planar sheet 46. Placing a card 34 in the slot 32 with the missing card warning device 36 would cause the longitudinal flap 44 to be forced in a direction towards the surface 40 of the planar sheet 46.

The longitudinal flap 44 as shown in FIG. 2 would alert a card owner to the fact that a card is missing. The longitudinal flap 44 in its outward biased position would impede the closing of the wallet 30. In addition, the longitudinal flap 44 could have an indicia to catch the card owner's attention. Indicia would include, for example, but not limited to, the longitudinal flap 44 being colored, coated with a light reflecting material, or containing a message or some design to catch the card owner's attention and alert the card owner to the fact that a card is missing from the wallet 30. Alternatively, the surface 40 under the longitudinal flap 44 could contain indicia such as, but not limited to, color, light reflecting material, a message, or a design, alerting the card owner to the situation in which a card is missing.

Figure 3:
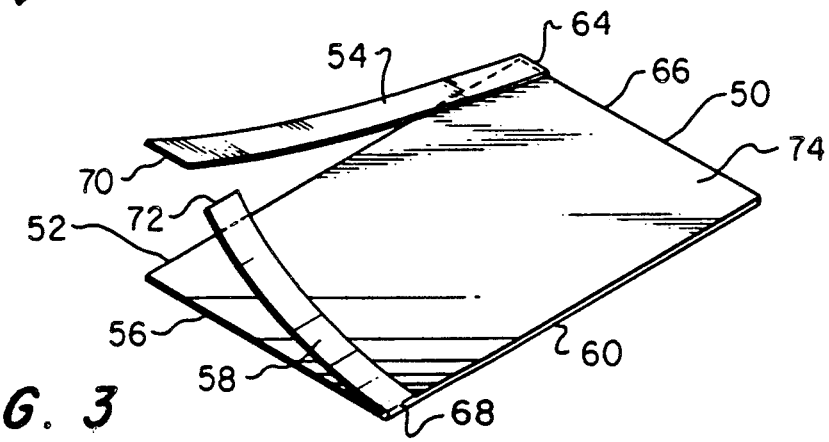
FIG. 3 is a perspective view of an embodiment of the invention.

FIG. 3 shows another embodiment of the invention, comprising a substantially planar sheet 50 with a longitudinal aligning edge 52 having a longitudinal flap 54 longitudinally aligned along it. The planar sheet 50 has a transverse aligning edge 56 with a transverse flap 58 longitudinally aligned along it. The planar sheet 50 also has a longitudinal vacant 60 and a transverse vacant edge 66. The longitudinal flap 54 has a longitudinal fixed edge 64 attached to the transverse vacant edge 66. The transverse flap 58 has a transverse fixed edge 68 attached to the longitudinal vacant edge 60. The longitudinal free edge 70 and the transverse free edge 72 are normally biased in a direction away from the surface 74 of the planar sheet 50. When pressure is applied against the flaps 54, 58 in a direction towards the surface 74, the free edges 70, 72 are forced towards the surface 74.

Figure 4:
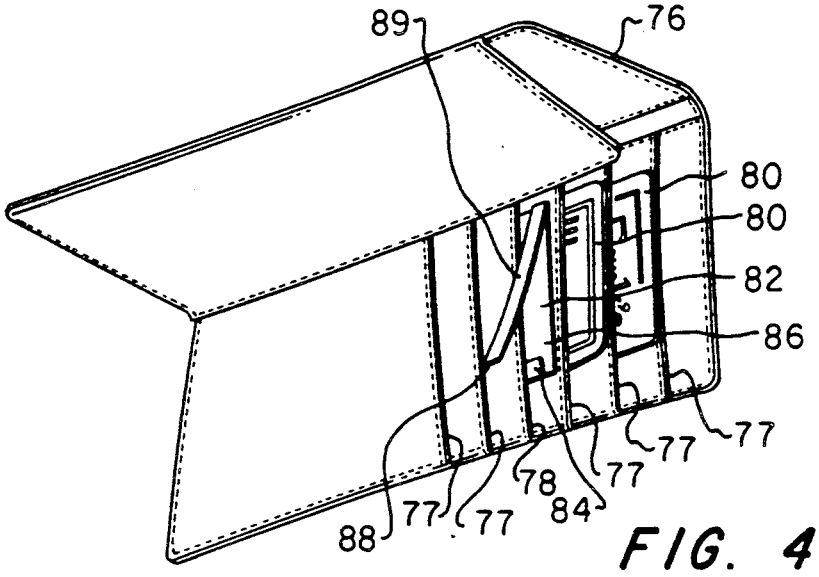
FIG. 4 is a perspective view of a card holder containing an embodiment of the invention in a card slot.

FIG. 4 depicts a wallet 76 having slots 77 and 78, containing cards 80 and the missing card warning device 82. With this wallet 76, the slots 77 and 78 are formed such that the longitudinal flap 84 is forced into a position against the surface 86 of the missing card warning device 82 when the missing card warning device 82 is placed into a slot 78. The transverse free edge 88 of the transverse flap 89 is in a position biased in a direction away from the surface 86 since a card has not been placed in front of the missing card warning device 82.

The embodiment of the invention having two flaps is configured to fit in slots formed to receive a long end or a short end of a rectangular card.

Figure 5:
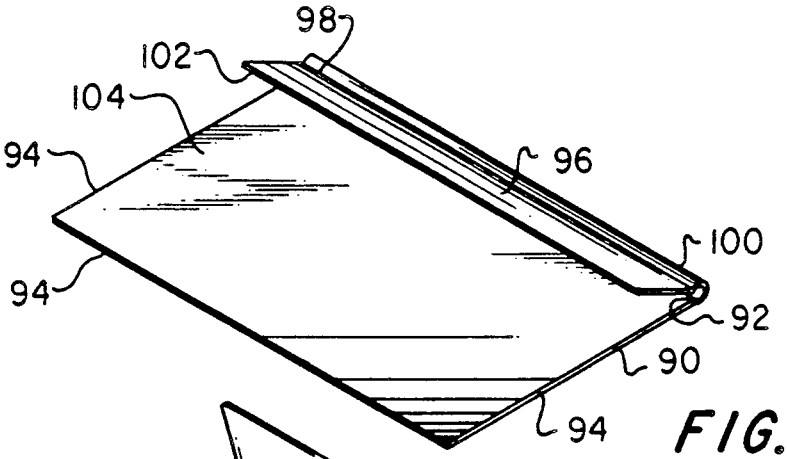
FIG. 5 is a perspective view of another embodiment of the invention.

FIG. 5 shows another embodiment of the invention comprising a substantially planar sheet 90 having an aligning edge 92 and three vacant edges 94 with a flap 96 aligned longitudinally along the aligning edge 92. The fixed edge 98 of the flap 96 is connected to the aligning edge 92 by a C-joint 100. The C-joint 100 biases the free edge 102 of the flap 96 into a position away from the surface 104 of the planar sheet 90. When force is applied against the flap 96 the free edge 102 of the flap 96 is forced in a direction towards the surface 104. The flap 96 can be pressed against the planar sheet 90 or, it can be flattened the other way, so that the flap 96 and the planar sheet 90 are coplanar.

Figure 6:
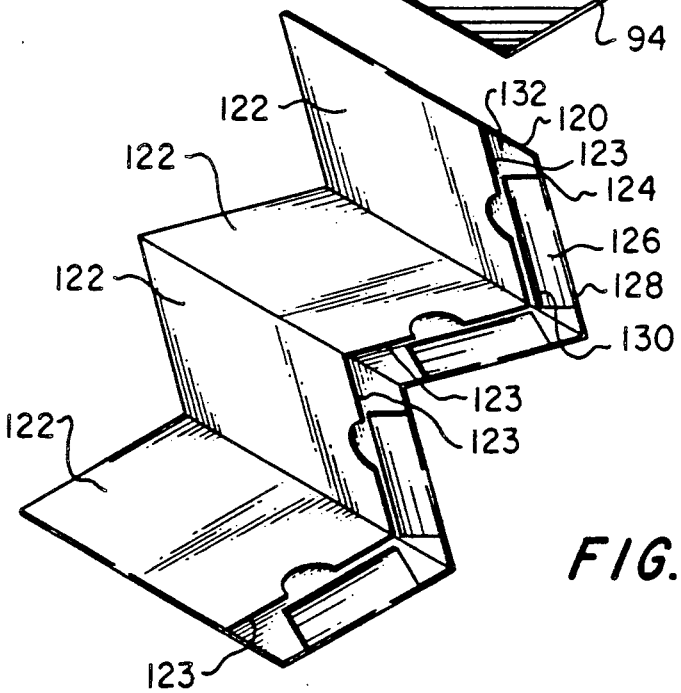
FIG. 6 is a perspective view of the invention incorporated into a card holder.

FIG. 6 depicts a card holder 120 containing pockets 122 configured to receive through slots 123. This card holder 120 has an aligning edge 124 with a flap 126 aligned longitudinally along the aligning edge 124. The flap 126 has a fixed edge 128 attached to the aligning edge 124. The free edge 130 of the flap 126 is normally biased away from the top surface 132. Pressure against the flap 126 results in the free edge 130 being forced in a direction towards the top surface 132.

Figure 7:
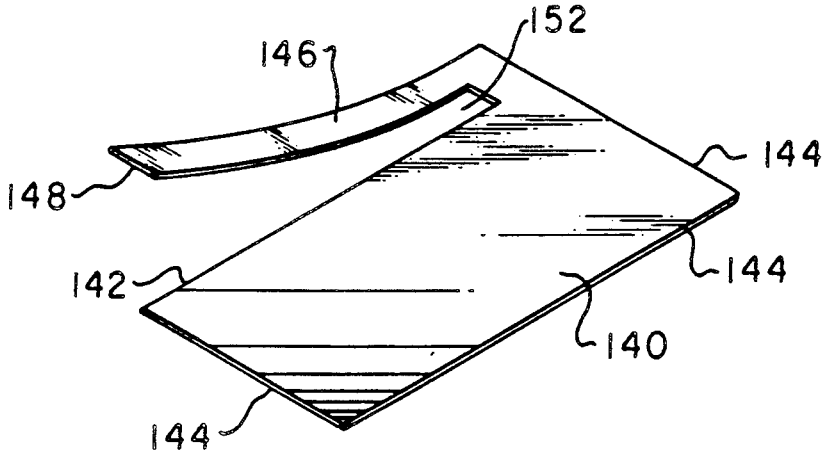
FIG. 7 is a perspective view of the invention where the flap may be forced into a position coplanar with the planar sheet.

FIG. 7 shows another embodiment of the invention comprising a substantially planar sheet 140, an aligning edge 142, and three vacant edges 144. A flap 146 is formed longitudinally along the aligning edge 142. The free edge 148 of the flap 146 is normally biased in a non-coplanar position relative to the planar sheet 140. When a force is applied against the free edge 148 or the flap 146, the flap 146 is forced into a coplanar position relative to the planar sheet 140. In this embodiment, a notch 152 is formed between the flap 146 and the aligning edge 142. The notch 152 can be of any width so long as it allows movement of the flap 146. In fact, a notch 152 is not necessary so long as the flap 146 can move independent of the aligning edge 142.

The flaps may be biased into the non-coplanar position by various means, including placing bends into the flap at various points such that the bends bias the flap into a V-shape or using a flap that curves such as the flap 146 shown in FIG. 7.

It should be noted that the flaps, also called substantially planar members, may be of different shapes and lengths. For example the transverse flap 89 of FIG. 4 could, at the transverse free edge 88, have an indicia in the shape of a corporate symbol, initials of the card owner, a school's mascot, or some other shape. These shapes could also be colored, coated with reflective material, or contain a design to alert a card owner that a card is missing from a slot 78.

Furthermore, although the preferred embodiments show a rectangular planar sheet, the planar sheet could be trapezoidal, triangular, or some other shape. The planar sheet only need to be of a shape that allows placement of the device behind a credit card in a slot. For example, the aligning edge may be substantially equal in length to an edge of a card, a short or long edge. The placement of the flaps needs to be such that at least one flap can be biased outward when the device is placed into a slot without a card in front of the device.

In another embodiment, the flap could be normally biased into a position away from the surface. When pressure is applied against the flap, the flap is forced into a position substantially parallel to the surface, rather than against the surface.

While the invention has been particularly shown and described with reference to a preferred embodiment, it will be understood by those skilled in the art that various changes in form and detail may be made therein without departing from the spirit and scope of the invention.

What is claimed is:

1. A device for alerting a card owner of a situation in which a card is missing from a card holder device having a plurality of slots for receiving cards comprising:

a substantially planar sheet having a surface, an aligning edge, and at least two vacant edges and being configured for placement in one of the plurality of slots in the card holder device;

a substantially planar indicator member positioned longitudinally along the aligning edge;

the substantially planar indicator member having a fixed end affixed to the substantially planar sheet and a free end;

the substantially planar sheet and the substantially planar indicator member being arranged so as to permit the substantially planar indicator member to be exposed outwardly of the one of the plurality of slots; wherein the substantially planar indicator member is resilient and shaped such that the free end is normally biased upwardly away from the plane of the surface of the substantially planar sheet;

whereby placement of the card in the one of the plurality of slots in front of the substantially planar indicator member forces the free end of the substantially planar indicator member toward the plane of the substantially planar sheet and removal of the card from the one of the plurality of slots permits the free end to extend upward to indicate to the card owner that the card is missing.

2. A device for alerting a card owner of a situation in which a card is missing from a card holder device having a plurality of slots for receiving cards comprising:

a substantially planar sheet having a surface, an aligning edge, and at least two vacant edges and being configured for placement in one of the plurality of slots in the card holder device;

a substantially planar indicator member positioned longitudinally along the aligning edge, the substantially planar indicator member having a free end and a fixed end affixed to the substantially planar sheet and a second substantially planar indicator member positioned longitudinally along a vacant edge, the second substantially planar member having a second free end and a second fixed end being affixed to the substantially planar sheet; and the substantially planar sheet and the substantially planar indicator members being arranged so as to permit at least one of the substantially planar indicator members to be exposed outwardly of the one of the plurality of slots; wherein the substantially planar indicator members are resilient and shaped such that the free ends are normally biased upwardly away from the plane of the surface of the substantially planar sheet;

whereby placement of the card in the one of the plurality of slots in front of the substantially planar indicator members forces the free ends of the substantially planar indicator members toward the plane of the substantially planar sheet and removal of the card from the one of the plurality of slots permits at least one of the free ends to extend upward to indicate to the card owner that the card is missing.

3. The device of claim 1 wherein the fixed end is affixed to the surface of the substantially planar sheet.

4. The device of claim 1 wherein the fixed end is affixed proximate the aligning edge.

5. The device of claim 1 wherein the fixed end is affixed proximate to a vacant edge.

6. The device of claim 1 wherein the substantially planar sheet comprises a plastic.

7. The device of claim 1 wherein the substantially planar indicator member comprises a metal.

8. The device of claim 1 wherein the aligning edge is substantially equal in length to an edge of the card.

9. The device of claim 1 wherein the aligning edge is substantially equal in length to a long edge of the card.

10. The device of claim 1 wherein the aligning edge is substantially equal in length to a short edge of the card.

11. A device for alerting a card owner of a situation in which a card is missing from a card holder device having a plurality of slots for receiving cards comprising:

a substantially planar sheet having a surface, an aligning edge, and at least two vacant edges and being configured for placement in one of the plurality of slots in the card holder device;

a substantially planar indicator member positioned longitudinally along the aligning edge;

the substantially planar indicator member having a fixed end affixed to the substantially planar sheet and a free end;

the substantially planar sheet and the substantially planar indicator member being arranged so as to permit the substantially planar indicator member to be exposed outwardly of the one of the plurality of slots;

a resilient C-joint for affixing the substantially planar member to the substantially planar sheet, the resilient C-joint having two mounting edges, the first mounting edge being attached to the fixed end of the substantially planar member and a second mounting edge being affixed to the aligning edge of the substantially planar sheet, and biasing the substantially planar member in a direction upwardly away from the plane of the surface;

whereby placement of the card in the one of the plurality of slots in front of the substantially planar indicator member forces the free end of the substantially planar indicator member toward the plane of the substantially planar sheet and removal of the card from the one of the plurality of slots permits the free end to extend upward to indicate to the card owner that the card is missing.

12. The device of claim 1 wherein an indicia is provided on at least one of a surface of said substantially planar indicator member and the surface of said substantially planar sheet which is visible when the free end is normally being biased in a direction away from the surface.

13. The device of claim 12 wherein the indicia is a message.

14. A device for alerting a card owner of a situation in which a card is missing from a card holder device having a plurality of slots comprising:

a substantially planar sheet having a surface, an aligning edge, and at least two vacant edges and being configured for placement in one of the plurality of slots in the card holder device;

a substantially planar indicator member positioned longitudinally along the aligning edge on the surface, the aligning edge being visible when said device is placed in the one of the plurality of slots in the card holder device; and the substantially planar indicator member having a fixed end being affixed to the planar sheet opposing a free end, the substantially planar sheet and the substantially planar indicator member being arranged so as to permit the substantially planar indicator member to be exposed outwardly of the one of the plurality of slots; wherein the substantially planar indicator member is resilient and shaped such that the free end is normally biased upwardly away from the plane of the surface of the substantially planar sheet; normally being biased away from a position parallel to the surface, the free end being forced into a position substantially parallel to the surface when the card is placed in the one of the plurality of slots in front of the device against the planar member, the free end extending upwardly away from the plane of the substantially planar sheet when the card is removed from the one of the plurality of slots, and becoming visible to the card owner, alerting the card owner that the card is missing.

15. The device of claim 14 wherein an indicia is provided on at least one of a surface of said substantially planar indicator member and the surface of said substantially planar sheet which is visible when the free end is normally being biased away from the surface.

16. A device for alerting a card owner of a situation in which a card is missing from a card holder device comprising:

a card holder device having a top surface containing a plurality of pockets under the top surface, each pocket being substantially planar and being configured to receive a card through a slot formed in the surface; and a planar indicator member aligned longitudinally along the slot, the planar member having a fixed end and a free end, the planar member being visible, the fixed end being affixed proximate to the slot and allowing the slot to receive the card and wherein the planar indicator member is resilient and shaped such that the free end is normally biased upwardly away from the plane of the top surface;

the free end being normally biased in a direction upward away from the top surface, the free end being forced in a direction towards the top surface when the card is placed in the slot against the planar member, the planar member becoming visible to the card owner when the card is removed from the slot.

whereby placement of the card in the one of the plurality of slots in front of the planar indicator member forces the free end of the planar indicator member toward the plane of the top surface and removal of the card from the one of the plurality of slots permits the free end to extend upward to indicate to the card owner that the card is missing.

17. The device of claim 16 wherein at least a portion of the free end is between the top surface and the card when the card is placed into the pocket through the slot.

18. A device for alerting a card owner of a situation in which a card is missing from a card holder device having a plurality of slots for receiving cards comprising:

a substantially planar sheet having an aligning edge and at least two vacant edges and being configured for placement in one of the plurality of slots in the card holder device; and a substantially planar indicator member formed longitudinally along the aligning edge on the surface, affixed at one end thereof to the aligning edge and extending parallel to the aligning edge; the substantially planar indicator member having a free end, wherein the substantially planar indicator member is resilient and shaped such that the free end is normally biased upwardly away from the plane of the surface of the substantially planar sheet; said free end of the substantially planer indicator member normally being biased in a non-coplanar position relative to the substantially planar sheet; the free end being forced into a position substantially coplanar relative to the substantially planar sheet when the card is placed in the one of the plurality of slots in front of the device against the substantially planar indicator member;

whereby placement of the card in the one of the plurality of slots in front of the substantially planar indicator member forces the free end of the substantially planar indicator member toward the plane of the substantially planar sheet and removal of the card from the one of the plurality of slots permits the free end to extend upward to indicate to the card owner that the card is missing.

* * * * *